US008500441B2

(12) United States Patent
Geiger et al.

(10) Patent No.: US 8,500,441 B2
(45) Date of Patent: Aug. 6, 2013

(54) METHOD FOR REGULATING AND CONTROLLING A FIRING DEVICE AND A FIRING DEVICE

(75) Inventors: Martin Geiger, Bogen (DE); Ulrich Geiger, Bogen (DE); Rudolf Tungl, Ergolding (DE)

(73) Assignee: EBM-Papst Landshut GmbH, Landshut (DE)

( * ) Notice: Subject to any disclaimer, the term of this patent is extended or adjusted under 35 U.S.C. 154(b) by 1159 days.

(21) Appl. No.: 11/629,019

(22) PCT Filed: Jun. 20, 2005

(86) PCT No.: PCT/EP2005/006627

§ 371 (c)(1),
(2), (4) Date: Aug. 30, 2007

(87) PCT Pub. No.: WO2006/000366

PCT Pub. Date: Jan. 5, 2006

(65) Prior Publication Data

US 2008/0318172 A1 Dec. 25, 2008

(30) Foreign Application Priority Data

Jun. 23, 2004 (DE) ..... 10 2004 030 299
Jun. 23, 2004 (DE) ..... 20 2004 017 851 U
Nov. 18, 2004 (DE) ..... 10 2004 055 716

(51) Int. Cl.
*F23N 1/00* (2006.01)
*F23N 3/04* (2006.01)
*F23N 3/06* (2006.01)

(52) U.S. Cl.
USPC ..... 431/12; 431/2; 431/18; 110/185; 110/188; 110/190; 236/1 A; 236/15 R; 236/15 BB; 236/15 BR; 432/19

(58) Field of Classification Search
USPC ... 431/12, 2, 18; 110/185, 188, 190; 236/1 A, 236/15 R, 15 BB, 15 BR; 237/2, 12; 432/19
See application file for complete search history.

(56) References Cited

U.S. PATENT DOCUMENTS 4,083,677 A * 4/1978 Hovis ..... 432/19
4,364,724 A * 12/1982 Alpkvist ..... 431/11

(Continued)

FOREIGN PATENT DOCUMENTS

AT 411 189 B 10/2003
DE 37 12 392 C1 10/1988

(Continued)

OTHER PUBLICATIONS

International Search report (in English) and Written Opinion of ISA (in German) for PCT/EP2005/006627, ISA/EP, Rijswijk, mailed Nov. 22, 2005.

(Continued)

*Primary Examiner* — Kang Hu
*Assistant Examiner* — Daniel E Namay
(74) *Attorney, Agent, or Firm* — Harness, Dickey & Pierce, P.L.C.

(57) ABSTRACT

A method is proposed for regulating a firing device taking into account the temperature and/or the burner load, in particular with a gas burner, comprising the regulation of the temperature ($T_{actual}$) produced by the firing device using a characteristic which shows a value range corresponding to a desired temperature ($T_{desired}$) dependent upon a first parameter ($m_L$, $V_L$) corresponding to the burner load (Q), wherein when representing the characteristic, a second parameter, preferably the air ratio (λ), defined as the ratio of the actually supplied quantity of air to the quantity of air theoretically required for optimal stoichiometric combustion, is constant.

23 Claims, 4 Drawing Sheets

U.S. PATENT DOCUMENTS

Figure 1:
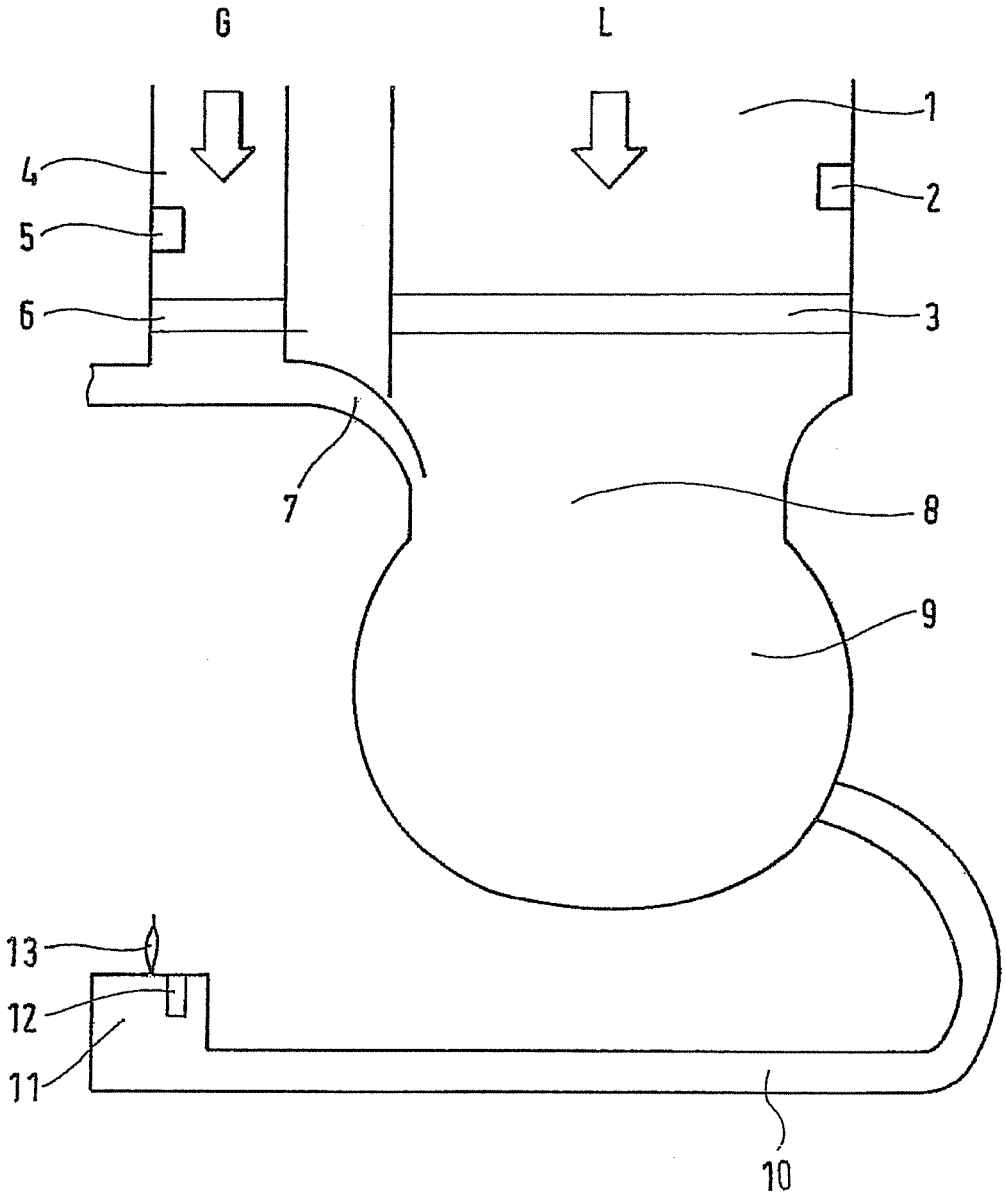

| | | | | | |
|---|---|---|---|---|---|
| 4,385,887 | A | * | 5/1983 | Yamamoto et al. | 431/90 |
| 4,681,530 | A | * | 7/1987 | Huber | 431/89 |
| 4,770,627 | A | * | 9/1988 | Yoshino | 431/18 |
| 4,865,540 | A | * | 9/1989 | Fitzgerald | 431/89 |
| 5,106,294 | A | * | 4/1992 | Profos | 431/12 |
| 5,367,470 | A | * | 11/1994 | Lang | 700/274 |
| 5,451,371 | A | * | 9/1995 | Zanini-Fisher et al. | 422/51 |
| 5,511,971 | A | * | 4/1996 | Benz et al. | 431/9 |
| 5,599,179 | A | * | 2/1997 | Lindner et al. | 431/12 |
| 5,667,375 | A | * | 9/1997 | Sebastiani | 431/12 |
| 5,899,683 | A | * | 5/1999 | Nolte et al. | 431/25 |
| 5,957,063 | A | * | 9/1999 | Koseki et al. | 110/188 |
| 5,971,745 | A | * | 10/1999 | Bassett et al. | 431/12 |
| 6,045,353 | A | * | 4/2000 | VonDrasek et al. | 431/79 |
| 6,050,807 | A | * | 4/2000 | Baek | 431/12 |
| 6,371,752 | B1 | * | 4/2002 | Kuroda et al. | 431/6 |
| 6,537,059 | B2 | * | 3/2003 | Lochschmied | 431/12 |
| 7,344,373 | B2 | * | 3/2008 | Vrolijk et al. | 431/12 |
| 2003/0054308 | A1 | * | 3/2003 | Abbasi et al. | 431/187 |
| 2004/0137390 | A1 | * | 7/2004 | Arnold et al. | 431/12 |

FOREIGN PATENT DOCUMENTS

| | | | | |
|---|---|---|---|---|
| DE | 39 37 290 | A1 | | 5/1990 |
| DE | 196 27 857 | A1 | | 1/1998 |
| DE | 100 45 270 | C2 | | 3/2002 |
| DE | 100 57 902 | A1 | | 5/2002 |
| EP | 0 697 637 | A | | 2/1996 |
| EP | 770 824 | B1 | | 5/1997 |
| EP | 1 002 997 | A2 | | 5/2000 |
| EP | 1 243 857 | A | | 9/2002 |
| EP | 1 293 727 | A | | 3/2003 |
| GB | 2 270 748 | A | | 3/1994 |
| JP | 57166416 | A | * | 10/1982 |
| JP | 62206319 | A | * | 9/1987 |
| JP | 62218724 | A | * | 9/1987 |
| JP | 63032218 | A | * | 2/1988 |
| JP | 01098818 | A | * | 4/1989 |
| JP | 02082015 | A | * | 3/1990 |
| JP | 04131610 | A | * | 5/1992 |
| JP | 04327713 | A | * | 11/1992 |
| JP | 05-060321 | A | | 3/1993 |
| JP | 08073946 | A | * | 3/1996 |
| JP | 2002147749 | A | * | 5/2002 |

OTHER PUBLICATIONS

IPER (in German), mailed Aug. 31, 2006.

* cited by examiner

METHOD FOR REGULATING AND CONTROLLING A FIRING DEVICE AND A FIRING DEVICE

The invention relates to a method for regulating a firing device, in particular a gas burner, with which a value, which is dependent upon a measured temperature produced by the firing device, is established. Moreover, the invention relates to a firing device, in particular a gas burner, which comprises a device for measuring a value which is dependent upon a temperature produced by the firing device. Furthermore, the invention relates to a method for controlling a firing device, in particular a gas burner, and a firing device, in particular a gas burner, which comprises a gas valve for setting the supply of fuel to the firing device.

In households, gas burners are used, for example as continuous-flow heaters, for preparing hot water in a boiler, for providing heating heat, etc. In the respective operating states, different requirements are made of the equipment. This relates in particular to the power output of the burner.

The power output is substantially determined by the setting of the supply of burnable gas and air and by the mix ratio between gas and air that is set. The temperature produced by the flame is also, among other things, a function of the mix ratio between gas and air. The mix ratio can, for example, be given as a ratio of the mass flows or the volume flows of the air and the gas. However, other parameters, such as the fuel composition, have an effect upon the values specified.

For every pre-determined air mass flow or gas mass flow a mix ratio can also be determined with which the effectiveness of the combustion is maximised, i.e. with which the fuel combusts the most completely and cleanly possible.

For this reason, it has proven to be wise to regulate the mass flows of gas and air and to constantly adjust them such that optimal combustion is respectively achieved as the requirements and basic conditions change. Regulation can take place continuously or at periodic intervals of times. In particular, regulation is necessary when changing the operating state, but for example also based upon changes in the fuel composition during continuous operation.

In order to prepare the air/gas mix which supplies the burner flame, known gas burners are generally equipped with a radial fan which, during operation, sucks in the air and gas mix. The mass flows of air and gas can be set, for example, by changing the speed, and thus the suction rate of the impeller of the radial fan. In addition, valves can be provided in the gas and/or air supply line which can be actuated to set the individual mass flows or their ratio. In order to measure individual parameters, different sensors can be disposed at suitable points. Appropriate measuring devices can therefore be provided for measuring the mass flow and/or the volume flow of the gas and/or the air and/or the mix. State values such as air temperature, pressures etc. can also be measured at suitable points, be assessed and used for the regulation.

Nowadays, regulation of the mix ratio takes place as standard, in particular with gas burners used in households, by means of pneumatic control of a gas valve dependent upon the volume flow of the quantity of air supplied (principle of the pneumatic combination). With the pneumatic control, pressures or pressure differences at restricting orifices, in narrowings or in venturi nozzles are used as control values for a pneumatic gas regulation valve by means of which the supply of gas to the air flow is set. However, a disadvantage of the pneumatic control is in particular that mechanical components have to be used which are associated with hysteresis effects due to friction. In particular with low working pressures, inaccuracies in control can occur so that the fan must constantly pro duce a specific minimum pressure in order to achieve sufficiently precise regulation, and this conversely leads, however, to oversizing of the fan for the maximum output. Moreover, the cost of producing the pneumatic gas regulation valves equipped with membranes is considerable due to the high requirements for precision. Moreover, in the pneumatic combination, changes to the gas type and quality can not be reacted to flexibly. In order to be able to make, nevertheless, the required adaptations of the gas supply, additional devices, e.g. correcting elements, must be provided and set, and this means considerable additional expense when fitting or serving a gas heating unit.

For these reasons one takes to providing gas burners with an electronic combination. With electronic control, controllable valves, possibly with pulse width modulated coils or with stepper motors, can easily be used. The electronic combination functions by detecting at least one signal characterising the combustion which is fed back to a control circuit for readjustment.

However, when using the electronic combination, situations also occur to which it is not possible to react appropriately, such as for example a change in the sensitivity of the sensors due to contamination. Moreover, when there are changes to the load or to the operating state, or directly after having set the gas burner in operation, there is the risk t regulation works with a time delay due to the inertia of the sensors, and this leads to incomplete combustion and, in an extreme case, to the burner flame being extinguished.

DE 100 45 270 C2 discloses a firing device and a method for regulating the firing device with fluctuating fuel quality. In particular when there is a change in the gas quality, the fuel air ratio is correspondingly altered. For every suitable type of fuel, the mix composition continues to be adjusted until the desired flame core temperature is reached. Moreover, characteristic diagrams are used for different fuels from which, with every change to the output requirements, a new, suitable fuel/air ratio is read out.

In GB 2 270 748 A, a control system for a gas burner is shown. Regulation takes place here using a temperature measured on the burner surface. Because the surface temperature is dependent upon the flow rate of the air/gas mix, if a specific temperature is not reached, the speed of the fan rotor is reduced, by means of which the air flow and so the air/gas ratio is reduced.

A method for regulating a gas burner is known from AT 411 189 B with which the CO concentration in the exhaust gases of the burner flame is measured using an exhaust gas sensor. A specific CO value corresponds to a specific gas/air ratio. Upon the basis of a known, e.g. experimentally established, gas/air ratio with a specific CO value, a desired gas/air ratio can be set.

EP 770 824 B1 shows regulation of the gas/air ratio in the fuel/air mix by measuring an ionisation flow which is dependent upon the excess of air in the exhaust gases of the burner flame. With stoichiometric combustion, it is known to measure a maximum ionisation flow. The mix composition can be optimised dependent upon this value.

It is a disadvantage with the latterly specified method, however, that the feedback signal is only detected with a burning flame and can be fed back to the control circuit. Moreover, the inertia of the sensors limits precise readjustment. Moreover, the sensors used are subject to contamination so that the combustion over the course of time is regulated sub-optimally, and so the contaminant values rise. In particular during the start-up process during which there is still no combustion signal, or with load changes, with which over a short period of time considerable changes to the operational parameters are required, difficulties can occur, and in an extreme case, the flame can be extinguished. For these reasons, one often additionally resorts to pneumatic regulators, but this is associated, however, with increased complexity of the unit and increased costs.

Upon this basis, it is an object of this invention to provide a simplified method for fuel-independent regulation of a firing device. A further object of the invention is to reliably guarantee a supply of fuel independent of gas-type, even with rapid load changes and during the start phase, without any time delays.

The method according to the invention for regulating a firing device, in particular a gas burner, comprises the steps: establishing a value which is dependent upon a measured temperature produced by the firing device; specifying a first parameter which corresponds to a specific burner load; and regulating the value which is dependent upon a temperature produced by the firing device using a characteristic which shows a value range corresponding to a desired temperature dependent upon the first parameter corresponding to a burner load, wherein when representing the characteristic, a second parameter, preferably the air ratio ($\lambda$), defined as the ratio of the actually supplied quantity of air to the quantity of air theoretically required for optimal stoichiometric combustion, is constant.

The invention is based upon the knowledge that a characteristic for regulating the value dependent upon a temperature produced by the firing device is not dependent upon the type of gas used. The method of regulation according to the invention is therefore not dependent upon the type of gas.

The temperature produced by the firing device is generally measured by a sensor disposed in the core of the flame or on the burner itself, for example on the surface of the burner. It can, however, also be measured at the foot of the flame, on the top of the flame, or some distance away in the effective region of the flame. The measured temperatures have values of between approximately 100° C. and 1000° C. dependent upon where the temperature sensor is applied, and dependent upon the load and upon the air/fuel ratio.

The characteristic given for a constant second parameter can be determined both empirically and by calculation. As a second parameter value the value is specified with which optimal combustion takes place with the burner provided. For example, the air ratio $\lambda$, which should favourably be $\lambda=1.3$, can be used as this second parameter value. The air ratio $\lambda$ is defined as the ratio of the actually supplied quantity of air to the quantity of air theoretically required for optimal stoichiometric combustion.

Among other things, the method is particularly simple and reliable such that the regulation can be implemented independently of the quality of the fuel, and so without analysing the fuel. Constant or periodic corrections to the characteristic or pre-selection from a set of characteristics for different fuels/gases are therefore dispensed with.

The first parameter corresponds, in particular, to a quantity of air supplied per unit of time to the firing device. This means representing a value corresponding to the desired temperature with a constant second parameter value dependent upon the quantity of air supplied to the burner flame per unit of time. A constant second parameter means, conversely, that when the quantity of air changes, the quantity of fuel supplied is correspondingly changed in order to maintain the stoichiometric ratio between air and burnable gas which is optimal for combustion.

The first parameter preferably corresponds to a mass flow or volume flow of air supplied to the firing device. The mass flow of air can, for example, be determined by a mass flow sensor in the supply duct for the air supplied to the burner. With a change to the load corresponding to a change to the air mass flow, with a constant second parameter the mass flow and the volume flow of the fuel change in the same way, and this can also be measured by a mass flow sensor disposed at a suitable point.

With a constant air ratio, the burner load is substantially in proportion to the quantity of air per unit of time supplied to the firing device. For the characteristic used it is therefore irrelevant whether the first parameter expresses, for example, an air or gas mass flow, or a load.

The method preferably comprises a comparison of the measured value dependent upon the temperature with a desired value established from the characteristic. As with most regulation processes, from a deviation of the actual temperature from the desired temperature value, an adjustment to the operating parameters which reduces this deviation is undertaken for as long or as frequently as is required until the deviation between the actual and desired value is leveled out. For example, with a measured temperature which lies below the desired temperature, by increasing the quantity of fuel supplied in steps, the mix is enriched until the deviation of the actual value from the desired value no longer exists. In the same way, with an excessively high actual temperature, the mix can be correspondingly thinned.

The value corresponding to the desired temperature is preferably established dependent upon the first parameter from the characteristic. If, for example, the mass flow of the air is chosen as the first parameter, the mass flow of the air is specified, and the desired temperature corresponding to this mass flow is read out from the characteristic. The regulation is continued until the value of the actual temperature corresponds to the desired temperature value.

The measured value and/or the value range of the characteristic corresponds in particular to a temperature difference. Thermoelements, for example, can be used for measuring temperature. In a particular embodiment, the temperature difference is a temperature difference between a temperature produced in the region of the burner flame and a reference temperature.

The reference temperature can correspond to the temperature of the air or of the air/combustion medium mix before passing into the range of the burner flame. If the temperature of the comparison point is known, the absolute temperature can also be established. Alternatively, the ambient temperature of the burner, for example, can also serve as a reference.

The regulation can comprise an increase or reduction in the quantity of gas supplied per unit of time. In this embodiment, therefore, the temperature is regulated by enriching or thinning the mix with fuel until the measured value dependent upon the actual temperature corresponds with the desired value.

The increase or reduction of the quantity of gas supplied per unit of time is implemented in particular by actuating a valve. For example, a stepper motor can actuate a correcting element of a valve or a pulse width can be modulated and an electrical value can be changed with an electrically controlled coil.

The firing device according to the invention, in particular a gas burner comprises: a de vice for measuring a value which is dependent upon a temperature produced by the firing device; means for regulating the temperature produced by the firing device specifying a first parameter which corresponds to a specific burner load, and using a characteristic which shows a value range corresponding to a desired temperature dependent upon the first parameter corresponding to the burner load; wherein when representing the characteristic, a second parameter, which corresponds to a ratio of a quantity of air to a quantity of combustion medium in a mix of air and combustion medium supplied to a firing de vice, being is.

The device for measuring the value dependent upon the temperature can be disposed in particular in the core of the flame, on the surface of the burner, at the foot of the flame or at the top of the flame. The inertia of the temperature sensor substantially depends upon the distance from the flame and upon the inert masses of the sensor and its attachment.

The first parameter can correspond to a quantity of air supplied to the firing device per unit of time, in particular to a mass flow or volume flow of the air.

The firing device preferably has a measuring device for measuring the quantity of air and/or of fuel medium and/or of air and fuel medium mix supplied to the firing device per unit of time, in particular for measuring a mass flow or a volume flow. The sensors are to be arranged in the apparatus such that the most reliable possible conclusion can be drawn with regard to the mass flows flowing through. This can be the case, for example, in a bypass. The burner load at a constant air ratio is generally substantially in proportion to the quantity of air supplied to the gas burner per unit of time.

The firing device can comprise means for comparing the value corresponding to the measured temperature with a desired value established from the characteristic.

The device for measuring a value dependent upon the temperature produced can be adapted to measure a value which corresponds to a temperature difference. From this temperature difference, with a known reference temperature, the absolute temperature can be determined.

The value corresponds in particular to a temperature difference between a temperature produced in the region of the burner flame and a reference temperature, the reference temperature corresponding in particular to the temperature of the air or of the air/combustion medium mix before passing into the region of the burner flame.

The device for measuring a temperature value preferably comprises a part which is disposed at least partially in the region of the reaction zone of the burner flame.

For the measurement of the reference temperature, a part of the device for measuring the temperature value can be disposed outside of the reaction zone of the flame, in particular in the region of an entry zone for the air supplied to the firing device and/or for the air/combustion medium mix supplied to the firing device.

The device for measuring a temperature value preferably comprises a thermoelement. A contact point for the different side pieces of the thermoelement is disposed here in the region of the reaction zone of the burner flame, the reference point being outside of this reaction zone, in order to detect a temperature difference between the flame and a region thermally uncoupled from the latter, for example a surrounding region of the gas burner.

The value measured by the device for measuring a temperature value is preferably a thermovoltage.

The regulating means can be adapted to increase and/or to reduce the quantity of combustion medium supplied to the firing device per unit of time.

In particular, the firing device comprises a valve which can be actuated to increase or reduce the quantity of gas supplied per unit of time.

With the further method according to the invention for controlling a firing device, in particular a gas burner, when there is a change to the first parameter, which corresponds to the burner load, from a start value to a target value, the supply of fuel to the firing device is adapted by a change to the opening of a gas valve from a first to a second opening value, and by specifying a desired value which is dependent upon the first parameter, the second opening value lying between an upper and lower limit value, and during the transition of the opening of the gas valve from the first to the second opening value, no regulation of the fuel supply being implemented, and only after reaching the target value of the first parameter, which corresponds to the burner load, regulation of operating parameters of the firing device being implemented.

With the help of this method, when there is a rapid load change, but also in particular during the start-up process, stable ratios can be achieved instantaneously. Readjustment of the gas valve which takes a long time if there are strong fluctuations in the operating parameters and is incomplete due to the inertia of the sensors, can therefore be dispensed with. Control takes the place of regulation, and this specifies a desired value for a new setting dependent upon the target value of the first parameter. Readjustments are only made in the subsequent step using real measurement values. With the method, rapid and reliable setting of the gas valve can be achieved independently of the inertia of the sensors used for the regulation. The real opening of the gas valve lies here between an upper and a lower limit value. With rapid changes to the desired value, the correcting elements, for example the ventilator or a gas control valve, can be readjusted after a certain period of time which depends upon the inertia of the sensors. With the embodiment of the method according to the invention, there is therefore a transition from pure control to regulation.

The parameter which corresponds to the burner load can be the quantity of air supplied to the firing unit per unit of time, in particular a mass flow or volume flow of the air sum plied to the firing device. The opening values of the gas valve can therefore be shown in this embodiment dependent upon the mass or volume flow of the air. The characteristics of this characteristic is determined among other things by the properties of the gas valve.

The burner load is substantially in proportion to the quantity of air supplied to the gas burner per unit of time. It is therefore established that the representation of the opening of the gas valve dependent upon the mass flow of the air is equivalent to a representation of the opening of the gas valve dependent upon a load of the burner.

The change to the opening of the gas valve can be implemented by modulation of a pulse width, by varying a voltage or a current of a valve coil, or by actuating a stepper motor of a valve. If the upper or the lower limit value for the opening of the gas valve is passed, this can be detected within the framework of the method. Whereas the opening of the gas valve lies between the upper and lower limit value after the control process, after the regulation step, the gas opening can lie above or below the upper or lower limit value. This can occur in particular when the desired values for the opening of the gas valve established when producing the characteristic strongly deviate from the optimally adjusted values. This can be caused by changes to the fuel composition, changes to the measuring characteristics of the sensors or to the settings of the equipment parameters.

The characteristic which is formed from the desired values for the opening of the gas valve dependent upon the parameter which corresponds to the burner load, can be recalibrated upon the basis of the operating parameters of the firing device set by the regulation. If, following regulation, the value of the opening of the gas valve falls outside of the range defined by the upper and the lower limit value, the characteristic can be recalibrated. With this re-calibration, the desired values can be shifted, for example, such that the new desired value characteristic extends through the adjusted value for the opening of the gas valve. In the same way, the upper and the lower limit values can be shifted so that the new desired value curve is surrounded by a tolerance corridor as with the previously applicable characteristic.

If the upper limit value is exceeded or the lower limit value is not reached, this can lead to the firing device shutting down, in particular after a pre-determined period of time has passed. Both considerations of safety and economic considerations can form the basis of this step. Regulation in a range outside of the desired zone specified by the limit values can, for example, indicate an undesired change to the pre-determined settings of the gas burner such that this may possibly be functioning in an unsafe or ineffective operating range. The equipment would consequently have to be examined and serviced.

A further firing device according to the invention, in particular a gas burner, comprises: a gas valve for setting the supply of fuel to the firing device; a storage unit for storing desired values, which are dependent upon a parameter which corresponds to the burner load, and upon upper and lower limit values; a device for controlling the opening of the gas valve which, when there is a change to the parameter, which corresponds to the burner load, from a start value to a target value, adapts the opening of the gas valve from a first to a second opening value according to a stored desired value, the second opening value lying between a stored upper and a lower limit value, and during the transition of the opening of the gas valve from the first to the second opening value no regulation of the fuel supply being implemented; and regulating means which, after the target value for the parameter has been reached which corresponds to the burner load, regulate operating parameters of the firing device. The regulation following the control step can take place, for example, using a method according to claims 1 to 24.

The gas valve can comprise a correcting element, in particular a stepper motor, a pulse width modulated coil or a coil controlled by an electrical value.

The firing device preferably has at least one mass flow sensor and/or volume flow sensor for measuring the quantity of air supplied to the firing device per unit of time and/or the quantity of fuel medium supplied per unit of time, and/or the quantity of the air and fuel medium mix supplied.

In particular, in the region of the burner flame the firing device can have a device for measuring a temperature produced by the firing device.

The temperature sensor can be disposed, for example, in the region of the flame, but also on the burner near to the flame. A thermoelement, for example, can also be used as a temperature sensor.

Figure 2:
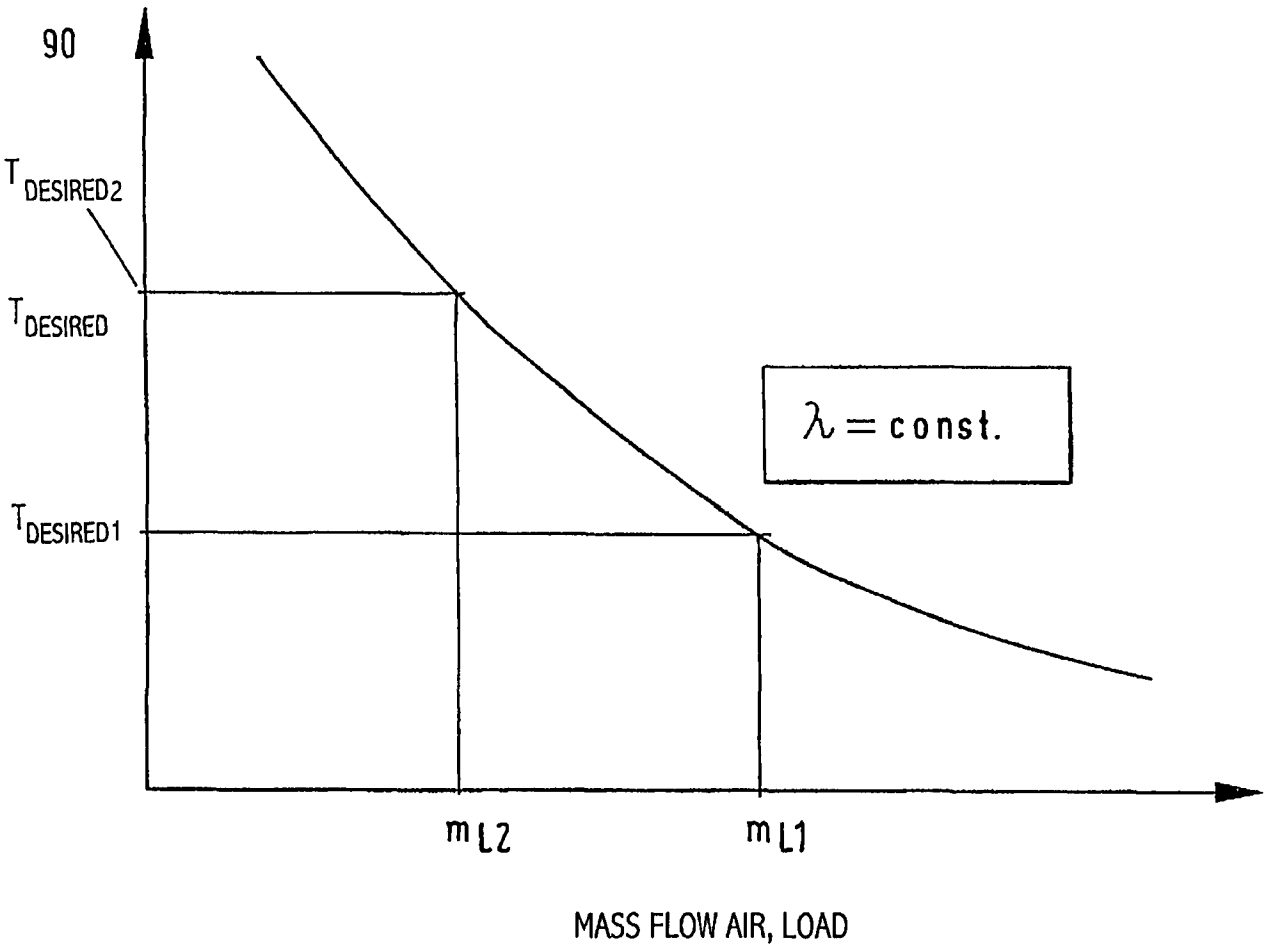
Figure 3:
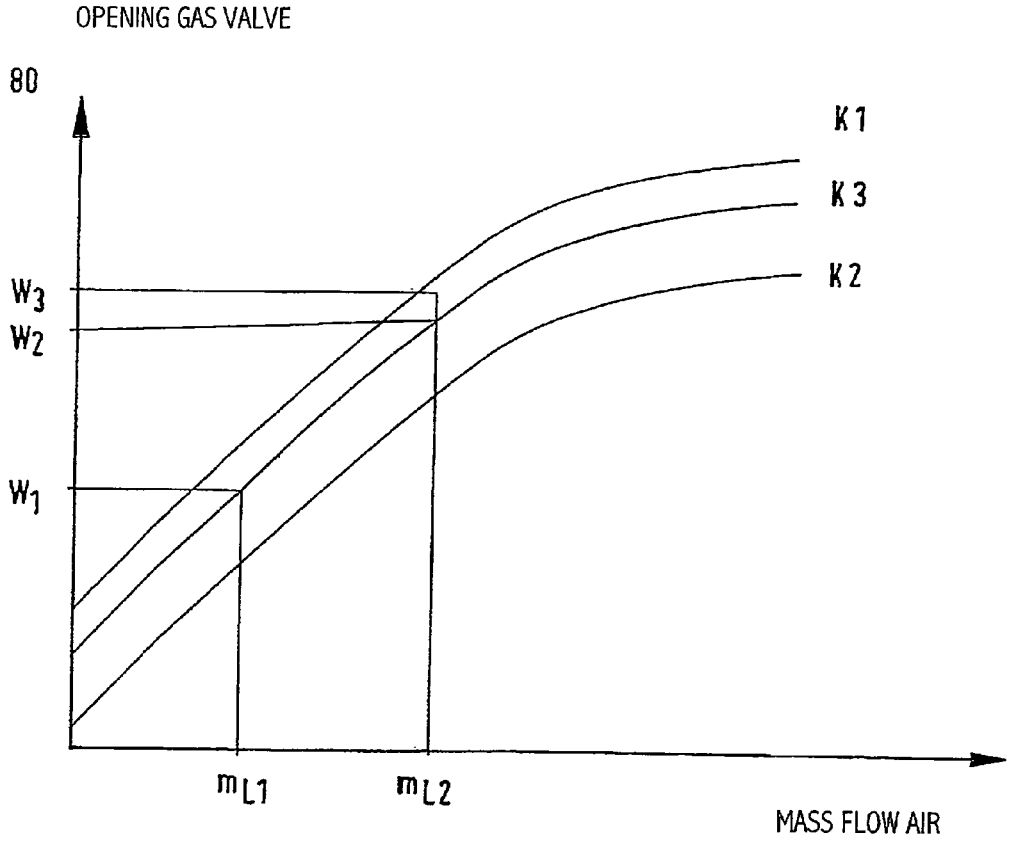
Figure 4:
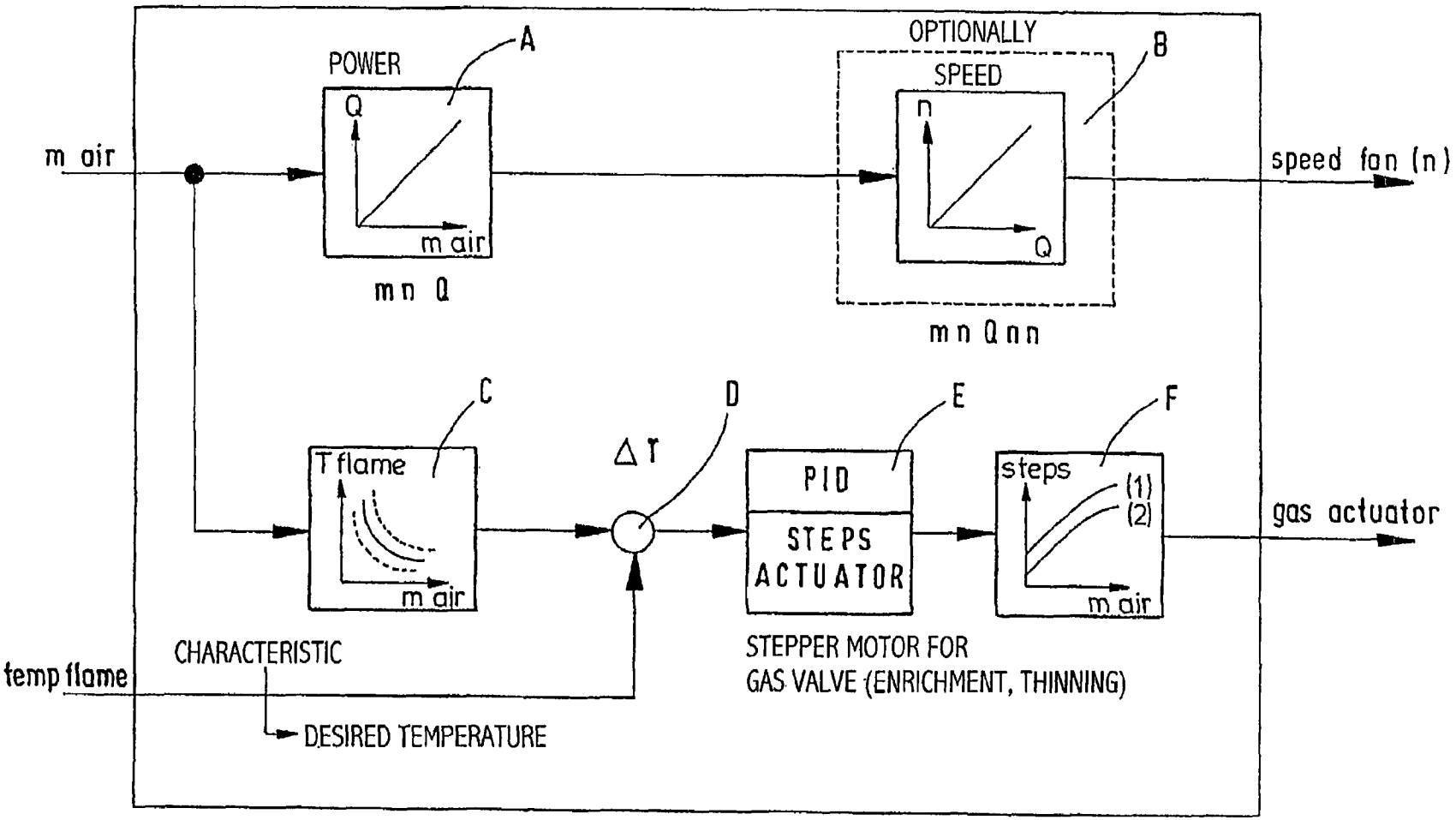

Further features and advantages of the object of the invention will become evident from the following description of particular examples of embodiments. These show as follows:

FIG. 1 a firing device according to this invention;

FIG. 2 a characteristic which is used when implementing the first method;

FIG. 3 a characteristic which is used when implementing the second method; and FIG. 4 a schematic illustration of a regulation structure for implementing a method.

FIG. 1 shows a gas burner with which a mix of air L and gas G is pre-mixed and combusted.

The gas burner has an air supply section 1 by means of which combustion air L is sucked in. A mass flow sensor 2 measures the mass flow of the air L sucked in by a fan 9. The mass flow sensor 2 is disposed such that the most laminar flow possible is produced around it so as to avoid measurement errors. In particular, the mass flow sensor could be disposed in a bypass (not shown) and using a laminar element.

A valve 3 for the combustion air can also be disposed in the air supply section 1. However, a regulated fan with an air mass flow sensor is generally used so that the valve can be dispensed with.

For the supply of gas, a gas supply section 4 is provided which is attached to a gas supply line. During operation of the gas burner, the gas flows through the section 4. By means of a valve 6, which can be an electronically controlled valve, the gas flows through a line 7 into the mixing region 8. Mixing of the gas G with the air L takes place in the mixing region 8. The fan 9 ventilator is driven with an adjustable speed so as to suck in both the air L and the gas G.

The valve 6 is set so that, taking into account the other operating parameters, for example the speed of the ventilator, a pre-determined air/gas ratio can pass into the mixing region 8. The air/gas ratio should be chosen such that the most clean and effective possible combustion takes place.

The air/gas mix flows via a line 10 from the fan 9 to the burner part 11. Here, it is discharged and feeds the burner flame 13 which is to emit a pre-determined heat output A temperature sensor 12, for example a thermoelement, is disposed on the burner part 11. With the help of this thermoelement an actual temperature is measured which is used when implementing the method described below for regulating and controlling the gas burner. In this example, the temperature sensor 12 is disposed on a surface of the burner part 11. It is also conceivable, however, to dispose the sensor at another point in the effective region of the flame 13. The reference temperature of the thermoelement is measured at a point outside of the effective region of the flame 13, for example in the air supply line 1.

A device (not shown) for controlling and regulating the air and/or gas flow receives input data from the temperature sensor 12 and from the mass flow sensor 2, and emits control signals to the valve 6 and to the fan 9 drive. The opening of the valve 6 and the speed of the fan 9 ventilator are set such that the desired supply of air and gas is provided.

Control takes place by implementing the method described below. In particular, the control device has a storage unit for storing characteristics and desired values, as well as a corresponding data processing unit which is set up to implement the corresponding method.

The first method according to the invention is described by means of FIG. 2. In FIG. 2 a characteristic is shown with which the desired temperature $T_{desired}$ is applied dependent upon a mass flow $m_L$ of the combustion air which is to be supplied to a gas burner. As can be seen from FIG. 2, a temperature is predetermined for the mass flow of the combustion air with a constant air ratio. For other values of the air ratio $\lambda$ there would be another dependency of the desired temperature $T_{desired}$ upon the air mass flow $m_L$. The observation which forms the basis of the method is that with a specific value of the mass flow of the combustion air for a pre-determined air ratio, the corresponding desired temperature $T_{desired}$ is not dependent upon the type of gas. Therefore, the method functions independently of the type of gas. The air ratio $\lambda$ is chosen such that the most hygienic and efficient combustion possible is achieved. For example, a value $\lambda=1.3$ can be specified. When implementing the method with the established air ratio $\lambda$, effective regulation is therefore achieved independently of the gas type and quality.

In order to clarify the method, the starting point is a change passing from an operating state 1 to an operating state 2. The change to the operating state requires a load change, for example a change to the heat requirement. An air mass flow $m_{L1}$ corresponds to operating state 1, and an air mass flow $m_{L2}$ corresponds to operating state 2. With a constant air ratio λ, the burner loading is substantially in proportion to the mass flows both of the air and of the fuel.

When implementing the method, the new air mass flow $m_{L2}$ is first of all set starting with a burner load $Q_{desired\ 2}$ desired in operating state 2. The air mass flow $m_L$ can be measured on a mass flow sensor 2.

The corresponding opening of the gas valve is set by means of the desired characteristic gas valve opening over mass flow.

Instead of the mass flows, volume flows could also be registered by means of an restricting orifice with a pressure gauge, as could other parameters, for example the speed of the fan 9 ventilator.

After setting the air mass flow $m_{L2}$ and the gas valve, the actual temperature $T_{actual}$ measured on the temperature sensor 12 in the region of the burner flame 13 is compared with the desired temperature $T_{desired2}$ corresponding to the newly set air mass flow $m_{L2}$ according to the characteristic of FIG. 2.

If a deviation between the actual and the desired value occurs, there is a readjustment. This readjustment is implemented by thinning or enriching the air/gas mix by actuating the gas valve 6. The gas valve 6 is adjusted until the regulation process is complete, i.e. until an actual temperature $T_{actual}$ corresponding to the desired temperature $T_{desired2}$ has been set.

Instead of absolute actual and desired temperatures, temperature differences $\Delta T_{actual}$, $\Delta T_{desired}$, as measured, for example, using a thermoelement, can also be used. Instead of the desired temperature $T_{desired}$, a thermovoltge $U_{desired}$ can correspondingly be applied dependent upon the air mass flow $m_L$. The reference temperature of the thermoelement 12 can, for example, be measured in the air supply section 1, in a burner region outside of the effective region of the burner flame 13 in the area surrounding the burner.

The characteristic shown in FIG. 2 can be represented empirically or by calculation. For fast regulation, it would be advantageous to use a sensor 12 disposed close to the flame 13 with low thermal inertia. Coated thermoelements with a coating made of materials which are suitable for oxidation processes at high temperatures have proven to be particularly effective and stable. In order to increase the life span of the temperature sensor 12 and to protect it from over-loading, there is the possibility of applying the sensor in a region which is a certain distance away from the flame 13. The measured temperatures $T_{actual}$ are, dependent upon the application location, burner load $Q_{desired}$ and air ratio λ between 100 and 1000° C.

With gas heating appliances with low modulation levels, errors which occur due to fluctuations in the ambient temperature and the ambient pressure as well as in the gas pressure and which lead to changing ratios between the air mass flow and the gas mass flow, can be disregarded when implementing the method. Here, the volume flow measurement which is generally more cost-effective in comparison to the mass flow measurement of the combustion air, can be used.

With reference to FIG. 3, a further method is described.

In FIG. 3 a dependency of the opening w of the gas valve 6, which determines the supply of fuel dependent upon the mass flow $m_L$ of the air supplied to the burner is shown. The middle curve K3 corresponds here to a desired value curve which gives the pre-determined opening values $w_{desired}$ of a gas valve 6 dependent upon a corresponding air mass flow $m_L$.

When there is a change to the pre-determined burner load Q, for example with a change to the operating state or when the unit is started up, the air mass flow $m_L$ is changed from a start value $m_L$, to a second value $m_{L2}$ and adapted to the new load $Q_2$.

Because with the relatively rapid transition of $m_{L1}$ to $m_{L2}$ regulation of the supply of gas would be greatly delayed temporally due to the inertia of the sensors, the regulation is shut down, and the opening value w of the gas valve is changed from the previously set value $w_1$ to a new desired opening value $w_2$. The value $w_2$ lies on the desired opening curve K3.

In any case, the opening of the gas valve being set lies between an upper limit curve K1 and a lower limit curve K2 which give a tolerance range for the opening of the gas valve. The upper limit curve K1 corresponds here to a maximum allowed opening of the gas valve, and the lower limit curve K2 to a minimum allowed opening of the gas valve 6.

After this, a regulation process follows. During the regulation process, the operating parameters of the firing device, in particular the setting of the valve 6 and the speed of the fan 9 ventilator is adapted such that the combustion process is optimised. Regulation can then take place in any way. In this example it is implemented by measuring a temperature $T_{actual}$ produced by the burner flame 13 in its effective region by means of a temperature sensor 12. Regulation can be implemented, for example, using the method described above.

It is possible to use pulse width modulated valves, an electronically controlled valve or a valve with a correcting element actuated by a stepper motor. The control signal for setting the opening of the gas valve can correspondingly e.g. trigger actuation of a stepper motor or change the pulse width, the voltage or the current of a coil. The air mass flows $m_L$ and gas mass flows $m_G$ are measured by mass flow sensors 2 and 5.

If in a phase of the method before or after implementation of the regulation process a valve opening w is now set, which lies above the upper limit curve K1 or below the lower limit curve K2, there are corresponding consequences. For example, leaving the tolerance corridor lying between K1 and K2 can lead to a calibration process. During the calibration, the conditions set after the regulation could be entered in a storage unit of the control device and be used for the next start-up. The desired value curve K3 can be shifted like the limit curves K1 and K2 so that there is also a consistent tolerance corridor for the opening of the gas valve 6 around the desired value curve K3 with the new curve.

Alternatively to this, crossing the limit curves K1 or K2 upwardly or downwardly after a certain period of time or with repeated passing over or passing below can cause the apparatus to shut down. It can occur that specific settings of the gas burner move over the course of time or certain basic conditions have changed such that there is a risk to safety or the gas burner is functioning in a non-effective operating state. A deviation of the opening of the gas valve from the allowed corridor can, for example, be caused by a deviation of the gas pressure from the permissible input pressure range or by a malfunction of the sensors. The shut-down can therefore be taken as an indication that checking and servicing of the apparatus is necessary.

By means of the method described it can be ensured that until effective regulation of the gas supply is implemented, a plausible opening $w_2$ of the gas valve can be set by the control, either by a load change of the gas burner or in the start phase. In this way, for example, the flame can be prevented from extinguishing during the load change.

By means of the method, it is guaranteed when the burner is started up that ignition is possible over a wide range, adapted to the pre-determined burner loading. With load changes rapid adaptation of the supply of gas to the new load takes place before the fine adjustment is achieved by means of subsequent regulation.

In FIG. 4 a control device for implementing one of the methods according to the invention is shown schematically and as an example.

The air mass flow $m_L$ measured and the actual temperature $T_{actual}$ measured in the region of the burner flame serve as input signals for the control device. As can be seen from the characteristic shown in Diagram A, the air mass flow $m_L$ is directly in proportion to the loading of the burner Q. Corresponding to the characteristic shown in Diagram B, the speed n of the fan, which is in proportion to the heat output, is read out from the established load and correspondingly set.

On the other hand, with load changes, the desired temperature $T_{desired}$ of the burner flame is established from the air mass flow $m_L$ input value, as shown in diagram C. For a specific air mass flow, a desired temperature is pre-determined. At an intersection point D, this desired temperature $T_{desired}$ is compared with the measured actual temperature $T_{actual}$. If there is a temperature difference ΔT, a regulation process takes place which is continued until the actual temperature $T_{actual}$ corresponds to the desired temperature $T_{desired}$. Convergence of the actual temperature $T_{actual}$ and the desired temperature $T_{desired}$ is, as shown schematically by diagram E, changed by actuating the stepper motor of a gas valve which determines the supply of fuel $m_G$. This brings about enrichment or thinning of the fuel/air mix which leads to an increase or reduction of the temperature produced by the burner.

In Diagram F the opening of the gas valve in the form of the staggered setting of the stepper motor of the gas valve dependent upon the air mass flow $m_L$ is shown. The characteristics (1) and (2) show an upper and lower limit curve. With a pre-determined air mass flow $m_L$, the opening of the gas valve, during and after the control and regulation processes, must come constantly within the target corridor defined by the curves (1) and (2). With upward or downward deviations, a corresponding measure can be introduced. For example, the gas burner can be shut down so as to rule out any risk to safety or ineffective operation. Just a warning signal can also be used, or re-calibration of specific characteristic curves can be carried out.

The invention claimed is:

1. An electronic method for regulating a firing device, taking into account a temperature in a region of a burner flame and/or a burner load, in particular with a gas burner with an electronic combination, the electronic method, comprising:

regulating the temperature in the region of the burner flame produced by the firing device using a characteristic which shows a value range corresponding to a desired temperature dependent upon a first parameter corresponding to the burner load, wherein when representing the characteristic a second parameter, a stoichiometric air ratio, defined as a ratio of an actually supplied quantity of air to a quantity of air theoretically required for optimal stoichiometric combustion, is constant and wherein the burner flame depends on a type and a quality of as supplied to the gas burner and the regulation of the desired temperature in the region of the burner flame is conducted at the constant air ratio value independent of the type and the quality of the gas.

2. The method according to claim 1, wherein the first parameter corresponds to a quantity of air supplied to the firing device per unit of time.

3. The method according to claim 2, wherein the first parameter corresponds to a mass flow or volume flow of the air supplied to the firing device.

4. The method according to claim 1, wherein the burner load is substantially in proportion to the quantity of air supplied to the firing device per unit of time.

5. The method according to claim 1, wherein the method comprises a comparison of a measured value dependent upon the temperature with a desired value established from the characteristic and corresponding to the desired temperature.

6. The method according to claim 5, wherein the value corresponding to the desired temperature is established dependent upon the first parameter from the characteristic.

7. The method according to claim 1, wherein a measured value and/or the value range of the characteristic correspond to a temperature difference.

8. The method according to claim 7, wherein the temperature difference is a temperature difference between the temperature in the region of the burner flame and a reference temperature.

9. The method according to claim 8, wherein the reference temperature corresponds to the temperature of the air or of the air/combustion medium mix before passing into the range of the burner flame.

10. The method according to claim 1, wherein the regulation comprises an increase or a reduction in an amount of combustion medium supplied per unit of time.

11. The method according to claim 10, wherein the increase or reduction in the quantity of combustion medium supplied per unit of time is implemented by actuating a valve.

12. An electronic firing device, in particular a gas burner which is part of an electronic combination, the electronic device comprising:

a device for measuring a value which is dependent upon a temperature in a region of a burner flame produced by the firing device;

means for regulating the temperature in the region of the burner flame produced by the firing device, specifying a first parameter which corresponds to a specific burner load and using a characteristic which shows a value range corresponding to a desired temperature dependent upon a first parameter corresponding to the burner load, wherein when representing the characteristic, a second parameter, a stoichiometric air ratio, defined as a ratio of an actually supplied quantity of air to a quantity of air theoretically required for optimal stoichiometric combustion, is constant and wherein the burner flame depends on a type and a quality of gas supplied to the gas burner and the regulation of the desired temperature in the region of the burner flame is conducted at the constant air ratio value independent of the type and the quality of the gas.

13. The firing device according to claim 12, wherein the first parameter corresponds to a quantity of air supplied to the firing device per unit of time, in particular to a mass flow or volume flow of the air.

14. The firing device according to claim 12, wherein the firing device has a measuring device for measuring the quantity of air and/or of fuel medium and/or of an air and fuel medium mix supplied to the firing device per unit of time, in particular for measuring a mass flow or a volume flow.

15. The firing device according to claim 12, wherein the firing device comprises means for comparing, a measured value dependent upon the temperature with a desired value established from the characteristic and corresponding to the desired temperature.

16. The firing device according to claim 12, wherein the device for measuring a value dependent upon the temperature produced is adapted to measure a value which corresponds to a temperature difference.

17. The firing device according to claim 16, wherein the value corresponds to a temperature difference between the temperature in the region of the burner flame and to a reference temperature, the reference temperature in particular being a temperature of the air or of the air/combustion medium mix before passing into the region of the burner flame.

18. The firing device according to claim 12, wherein the device for measuring a temperature value comprises a part which is disposed at least partially in the region of the reaction zone of the burner flame.

19. The firing device according to claim 12, wherein for the measurement of a reference temperature, part of the device for measuring the temperature value is disposed outside of the reaction zone of the flame, in particular in a region of an input zone for the air and/or the air/combustion medium mix supplied to the firing device.

20. The firing device according to claim 12, wherein the device for measuring a temperature value comprises a thermoelement.

21. The firing device according to claim 12, wherein the value measured by the device for measuring a temperature value is a thermovoltage.

22. The firing device according to claim 12, wherein the regulating means are adapted to increase and/or to reduce the quantity of combustion medium supplied to the firing unit per unit of time.

23. The firing device according to claim 12, wherein the firing device comprises a valve which can be actuated to increase or to reduce the quantity of combustion medium supplied per unit of time.

* * * * *